United States Patent [19]

Kleykamp et al.

[11] 4,327,839

[45] May 4, 1982

[54] WEAR MEMBER FOR RAILWAY VEHICLE AND METHOD OF MAKING SAME

[75] Inventors: Donald L. Kleykamp, Dayton, Ohio; Julien C. Mathieu, Waynesville, N.C.

[73] Assignee: Dayco Corporation, Dayton, Ohio

[21] Appl. No.: 170,501

[22] Filed: Jul. 21, 1980

[51] Int. Cl.[3] ..... B61G 9/22; B61G 7/10

[52] U.S. Cl. ..... 213/61; 213/60; 308/3 R

[58] Field of Search ..... 213/21, 51, 60–62 R; 105/199 C, 199 CB, 225; 308/3 R

[56] References Cited

U.S. PATENT DOCUMENTS

| | | | |
|---|---|---|---|
| 3,860,121 | 1/1975 | Snell | 213/62 R |
| 4,237,792 | 12/1980 | Somers | 105/199 C |
| 4,238,039 | 12/1980 | Cooper et al. | 213/61 |

*Primary Examiner*—Randolph A. Reese

*Attorney, Agent, or Firm*—Joseph V. Tassone

[57] ABSTRACT

A wear member for use between a pair of relatively movable components of a railway vehicle and method of making the same are provided wherein the wear member has a support provided with a continuous supporting surface. Polymeric material is attached to the support and is supported by the continuous supporting surface thereof whereby the polymeric material has an outer antifriction wear surface. A comparatively rigid load-carrying member is embedded in the polymeric material and the load-carrying member serves to maintain the polymeric material free of substantial indentation under conditions of high impact loads applied simultaneously against the load-carrying member and the polymeric material, the load-carrying member having a peripheral side surface being engaged by the polymeric material completely around the entire peripheral side surface so that the load-carrying member is completely surrounded at the peripheral side surface thereof by the polymeric material.

20 Claims, 5 Drawing Figures

WEAR MEMBER FOR RAILWAY VEHICLE AND METHOD OF MAKING SAME

BACKGROUND OF THE INVENTION

1. Field of the Invention

This invention relates to railway vehicles and in particular to a wear member for use between relatively movable components of a railway vehicle.

2. Prior Art Statement

The railway industry utilizes various types of wear members between relatively movable components thereof and one type of such wear member which has been used satisfactorily employs an ultra high molecular weight (UHMW) polymeric material for the purpose of providing the desired antifriction properties and such material is attached against a metal supporting material which supports the polymeric material throughout its entire area for optimum structural strength. An example, of such a wear member is disclosed in United States Patent application Ser. No. 27,340, filed Apr. 5, 1979 now U.S. Pat. No. 4,238,039. However, it would be desirable to provide such a wear member which has increased capability of withstanding high impact loads routinely encountered in railway car couplers, such as couplers designated by the Association of American Railroads as F-type interlocking couplers.

SUMMARY

It is a feature of this invention to provide a wear member for a railway vehicle in which such wear member is comprised basically of a metal support having a continuous supporting surface, an ultra high molecular weight polymeric material supported by the continuous supporting surface of the metal support, and comparatively rigid load-carrying means embedded in the polymeric material wherein the load-carrying means serves to maintain the polymeric material free of substantial indentation under conditions of high impact loads applied simultaneously against the load-carrying means and the polymeric material.

Another feature of this invention is to provide a wear member of the character mentioned in which the load-carrying means is a load-carrying bar made of a metallic material.

Another feature of this invention is to provide a wear member of the character mentioned in which the load-carrying bar is of solid cross-sectional configuration and has an inner surface thereof supported against the continuous supporting surface of the metal support and an outer surface thereof which is disposed substantially coplanar with an outside antifriction wear surface defined by the exposed wear surface of the polymeric material.

Another feature of this invention is to provide a wear member of the character mentioned in which the metal load-carrying bar is fixed against the metal support by suitable weld means.

Another feature of this invention is to provide a wear member of the character mentioned which may be in the form of a coupler carrier wear member and is particularly adapted to be used with an F-type interlocking coupler mentioned above.

Another feature of this invention is to provide a wear member of the character mentioned in which the polymeric material is polyethylene having a molecular weight of at least two million.

Another feature of this invention is to provide an improved method of making a wear member of the character mentioned.

Therefore, it is an object of this invention to provide an improved wear member and method of making same having one or more of the novel features set forth above or hereinafter shown or described.

Other details, features, uses, objects, and advantages of this invention will become apparent from the embodiment thereof presented in the following specification, claims, and drawing.

BRIEF DESCRIPTION OF THE DRAWING

The accompanying drawing shows present preferred embodiments of this invention, in which.

DETAILED DESCRIPTION

Figure 1:
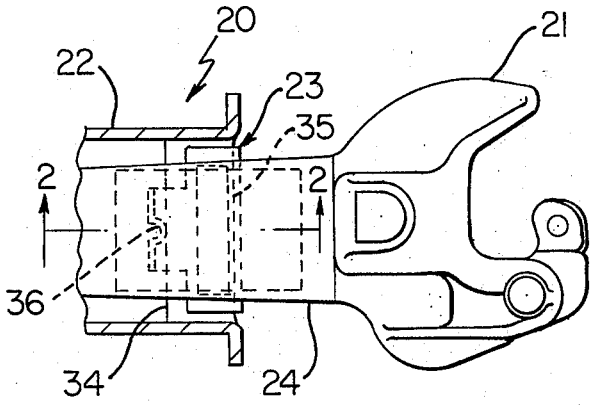
FIG. 1 is a fragmentary top plan view of an end portion of a freight car showing a coupler and coupler carrier thereof with one exemplary embodiment of a wear member provided in accordance with the teachings of this invention disposed therebetween.
Figure 2:
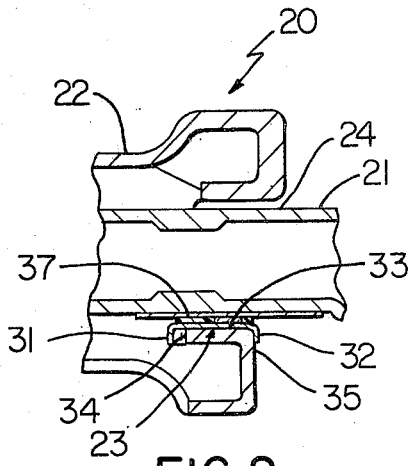
FIG. 2 is a fragmentary cross-sectional view taken essentially on the line 2—2 of FIG. 1.

Reference is now made to FIGS. 1 and 2 of the drawing which illustrate a fragmentary portion of one end of a railway vehicle 20 and such vehicle has a coupler assembly 21 and a coupler carrier 22. The coupler assembly 21 and coupler carrier 22 are relatively movable and will be considered as the relatively movable components or members of the railway vehicle in this example of the invention. A wear member, shown as a coupler carrier wear member and designated generally by the reference numeral 23, is provided and supported by one of the components and in this example such wear member 23 is supported by the coupler carrier 22. The wear member 23 protects the components 21 and 22 and in particular the shank portion 24 of the coupler assembly 21 and the adjoining portion of the coupler carrier 22 from excessive wear during relative movement thereof.

Figure 3:
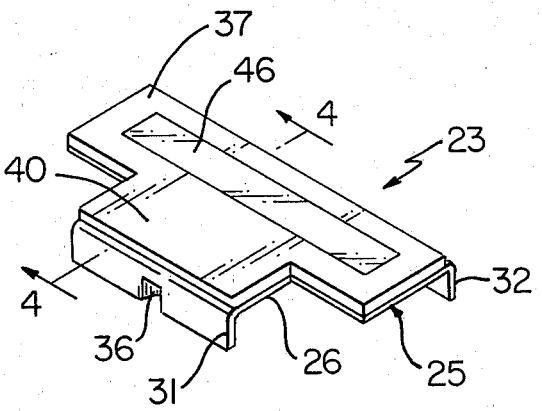
FIG. 3 is a perspective view of the exemplary coupler carrier wear member of FIGS. 1 and 2.
Figure 4:
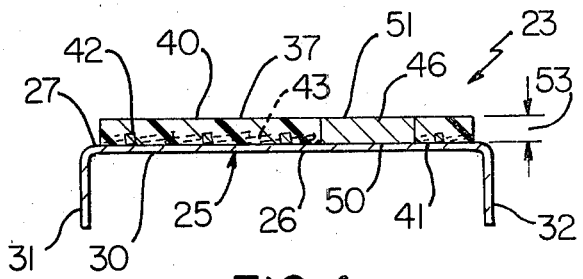
FIG. 4 is a cross-sectional view taken essentially on the line 4—4 of FIG. 3.

The wear member 23 comprises a metal support 25 which has a substantially planar sheet like or sheet portion 26 which has a continuous, i.e., uninterrupted, supporting surface 27 and a surface 30 defining an opposite surface of the sheet portion 26, and as best seen in FIGS. 3 and 4. The planar sheet portion 26 of the support 25 is substantially T-shaped and has a pair of depending flanges 31 and 32 which are defined as an integral part of the sheet portion 26 and extend perpendicularly in the same direction from opposite side edges of such sheet portion.

As shown in FIG. 2, the surface 30 is particularly adapted to be supported on a surface 33 of the coupler carrier 22 with the flanges 31 and 32 engaging associated surfaces 34 and 35 respectively of the coupler carrier to thereby hold the wear member in position on the coupler carrier 22 and between the assembly 21 and carrier 22. The flange 31 has a substantially semicylindrical locating projection 36 defined as an integral part thereof and such projection is adapted to be received in an associated cooperating recess in the surface 34 for the purpose of locating the wear member on the coupler carrier 22 at a precise position.

The wear member 23 comprises polymeric material which is preferably in the form of ultra high molecular weight (UHMW) polymeric material 37 which has an antifriction surface 40 which is engageable, i.e., particularly adapted to be engaged, by the coupler assembly 21. The polymeric material 37 has an inside surface 41 which is disposed against the continuous supporting surface 27 of sheet portion 26 and thus is completely supported by surface 27.

The wear member 23 has means attaching the polymeric material 37 to the metal support 25 and in particular to the supporting surface 27 of the sheet portion 26 of the metal support 25 and such attaching means comprises a metal structure in the form of an expanded metal structure 42. The structure 42 has openings 43 therein and a representative few of such openings are designated by the same reference numeral 43. The wear member 23 has mechanical means in the form of a plurality of welds 44 fixing the structure 42 to the metal support 25. The polymeric material 37 is disposed around the metal structure 42, through the openings 43, and against the surface 27 of the sheet portion 26; and, with the metal structure 42 fixed in position, the expanded metal structure 42 serves to attach the polymeric material 37 to the metal support 25, provide reinforcement of the polymeric material, and prevent cold flow of such polymeric material.

Figure 5:
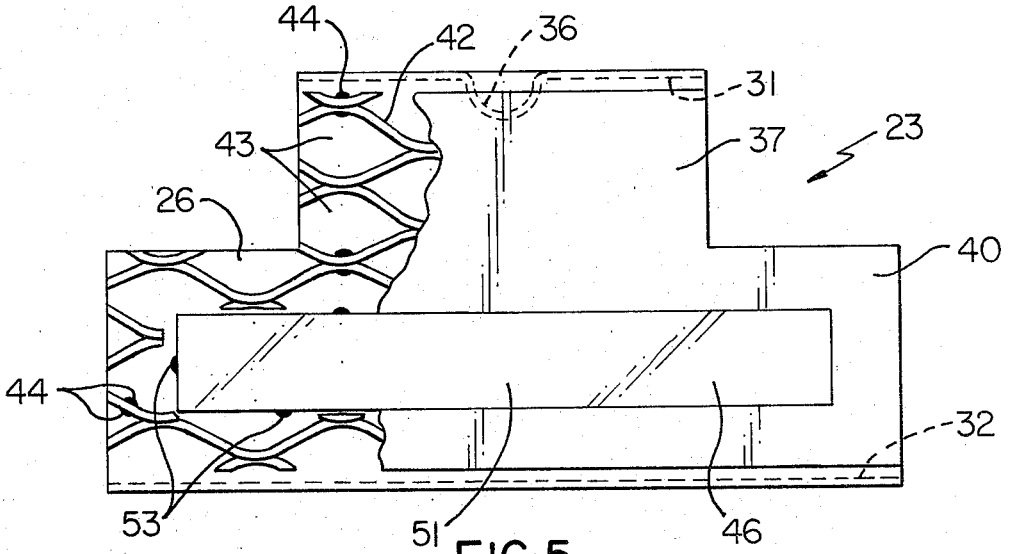
FIG. 5 is an enlarged plan view of the coupler carrier wear member of FIG. 3 with a portion thereof broken away to illustrate details of its construction.

In accordance with the teachings of this invention the wear member 23 has integral load-carrying means shown in this example of the invention as a load-carrying bar 46. The load-carrying means or bar 46 is preferably made of a metallic material and has inner surface means 50 (FIGS. 4 and 5) thereof engaging the continuous supporting surface 27 and outer surface means 51 thereof disposed substantially coplanar with the antifriction wear surface 40. The bar 46 is of solid cross-sectional configuration throughout and serves to maintain the polymeric material 37 free of substantial indentation or compression under conditions of high impact loads or the like applied simultaneously against the load-carrying means or bar 46 and the polymeric material 37.

During normal operation of certain types of railway vehicles, particularly those using couplers designated by the Association of American Railroads as F-type couplers there is a tendency for the coupler assembly 21 to be urged repeatedly with great forces, often impact forces, against the coupler carrier 22. However, the metal load-carrying bar 46 is disposed substantially across the entire length of the transverse arm of the T-shaped support 25 whereby such bar 46 serves to maintain the components 21 and 22 spaced apart by a distance equal to the thickness 53 of such bar, which in this example is shown as being equal to the thickness of the polymeric material 37, whereby the polymeric material 37 is maintained free of substantial compressive loads (which ordinarily would tend to provide localized bulging or substantial indentation therein) thereby reducing wearing tendencies in the polymeric material.

The use of the load-carrying bar 46 may create a tendency for some wear in that portion of the shank 24 of coupler 21 engaging the bar 46. However, in actual practice, wear of the shank 24 is kept at a minimum because a substantial portion (over half of the surface area) of the antifriction surface 40 is defined of UHMW polymeric material and only a comparatively small portion of such surface is defined by the outer surfaces 51 of the load-carrying bar 46. In addition, during normal usage and with the outer surface 51 of bar 46 exposed there is a tendency for a film or very small thickness, generally of the order of microns, of the polymeric material 37 to be scraped from the antifriction surface 40 and across the outer surface 51 of the load-carrying bar 46 with such film imparting antifriction properties to the outer surface 51. Thus, with repeated sliding movement of the coupler shank 24 over the surface 51 and antifriction surface 40 the polymeric material 37 serves as a lubricant for the surface 51.

It will also be appreciated that the description of surface 51 being substantially coplanar with surface 40 is intended to be fully applicable to situations wherein initially the surface 51 is beneath the surface 40. In this instance with wear of the polymeric material 37 the surface 51 may become exposed whereupon the description in the preceeding paragraph is fully applicable.

The bar 46 preferably has the shape of a rectangular parallelepiped. Accordingly, as seen in FIG. 4 of the drawing, the inner and outer surface means or surfaces 50 and 51 respectively thereof are defined as substantially planar surfaces which are disposed in spaced parallel relation.

The wear member 23 comprises means fixing the bar 46 against the continuous supporting surface 27, and although any suitable mechanical fixing means may be employed, in this example of the invention such fixing means comprises a plurality of welds 53 which fix the bar 46 with its inner surface 50 against the supporting surface 27.

The support 25, metal structure 42, and bar 46 may be made of suitable metallic material including ferrous material as well as nonferrous material. In one application of this invention these three components were all made of ferrous material.

The wear member 23 is preferably made utilizing the method in accordance with the teachings of this invention. Accordingly, the method comprises the steps of providing a metal support 25 with the support having a substantially planar main portion 26 provided with a continuous supporting surface 27 and a pair of depending legs or flanges 31 and 32 extending in the same direction from opposite side edges of the main portion. The flanges 31-32 are adapted to be supported by cooperating parts of the coupler carrier 22 and such flanges may be defined as an integral part of the main portion 26 as a single piece structure, as provided herein, or may be separate pieces suitably fixed to portion 26.

The method comprises attaching polymeric material 37 to the support 25 with the material 37 defining an antifriction wear surface 40 engageable by a coupler assembly 21 of the railway vehicle and such method includes embedding comparatively rigid load-carrying means or bar 46 in the polymeric material 37 with inner surface means or surface 50 thereof engaging the continuous supporting surface 27 and outer surface means or surface 51 thereof disposed substantially coplanar with the wear surface 40. The load-carrying bar 47 serves to maintain the polymeric material 37 free of substantial indentation under condition of high impact loads applied simultaneously against the load-carrying bar 46 and said polymeric material 37.

In providing the support 25, such support is made from suitable metallic materials as is known in the art. The load-carrying bar 46 is then suitably fixed to the planar sheet portion 26 of support 25 and the fixing action is achieved such that the inner surface 50 of the bar 46 is disposed against the surface 27 and suitable spot welds 53 used to fix the bar 46 in position. In this example, the expanded metal 42 is then welded to the surface 27 of the sheet-like portion 26 of the support 25 by spot welds 44. The polymeric material 37 is then suitably formed in position around the bar 46 and expanded metal structure as will now be described.

The polymeric material 37 may be suitably formed in position employing any technique known in the art and such polymeric material may be provided in either powder, flake, pellet, or similar form and supported in position by a suitable die or mold structure (which is capable of being heated) around and against the metal support 25. The entire assembly including the mold structure may then be supported on a stationary platen of a press and a ram of such press employed for applying pressure to the polymeric material through the mold structure while subjecting the mold structure to a controlled temperature condition to thereby define the polymeric material which upon cooling thereof is in the completed form illustrated in the drawing. It will also be appreciated that the polymeric material 37 may be provided in molten form and cooled and solidified in position in a suitable mold device.

However, regardless of how polymeric material 37 is provided and defined in position, once the mold structure is utilized to define the configuration of the polymeric material 37 around the expanded metal structure 42 and the load-carrying bar 46 such polymeric material is then suitably cooled to solidify same. The mold structure is then removed and any flashing removed whereupon the completed wear member is ready for use.

The polymeric material 37 may be any suitable polymeric material utilized in the railroad art. Preferably such polymeric material is an ultra high molecular weight synthetic plastic material having a molecular weight of at least two million. The preferred ultra high molecular weight polymeric material is polyethylene having a weight within the range of four to six million and in determining the molecular weight, the preferred technique employed is known as the intrinsic viscosity test and is widely used in the United States.

Reference has been made throughout this disclosure to the utilization of load-carrying means in the form of a load-carrying member or bar 46 comprising the wear member 23. However, it will be appreciated that a plurality of members may be utilized, if desired. Further, the load-carrying bar or members need not necessarily be of a particular configuration but may be of various configurations as long as the outer surface of the one or more bars employed is disposed substantially coplanar with the antifriction surface 40 of the polymeric material 37, with this description of substantially coplanar being essentially as described previously in this specification.

In this example of the invention the wear member 23 utilizes expanded metal structure 42 to attach its polymeric material in position to metal support 25. However, it will be appreciated that any suitable means may be used to attach the polymeric material to support 25.

It will also be appreciated that the area of the outer surface 51 of one or more load-carrying bars 46 should be small compared with the total area of the antifriction surface 40. The preferred ratio is to have the outer surface area 51 of the load-carrying bar 46 defining less than 50% of the total area of the antifriction surface 40.

While present exemplary embodiments of this invention, and methods of practicing the same, have been illustrated and described, it will be recognized that this invention may be otherwise variously embodied and practiced within the scope of the following claims.

What is claimed is:

1. In a wear member for a railway vehicle wherein said vehicle comprises a pair of relatively movable components and said wear member is supported by one of said components and protects said components from wear during relative movement thereof; said wear member comprising a metal support having a continuous supporting surface; an ultra high molecular weight polymeric material supported by said metal support and having an antifriction wear surface engageable by said other component; and means attaching said polymeric material to said metal support; the improvement comprising, comparatively rigid load-carrying means embedded within said polymeric material, said load-carrying means having inner surface means thereof engaging said continuous supporting surface and outer surface means thereof disposed substantially coplanar with said wear surface, said load-carring means having peripheral side surface means extending between said inner and outer surface means thereof and being engaged by said polymeric material completely around said entire peripheral side surface means so that said load-carrying means is completely surrounded at said peripheral side surface means thereof by said polymeric material, said load-carrying means serving to maintain said polymeric material free of substantial indentation under conditions of high impact loads applied simultaneously against said load-carrying means and said polymeric material.

2. A wear member as set forth in claim 1 in which said load-carrying means comprises a load-carrying bar made of a metallic material.

3. A wear member as set forth in claim 2 in which said bar is of solid cross-sectional configuration and said inner and outer surface means thereof are defined as substantially planar surfaces which are disposed in spaced parallel relation.

4. A wear member as set forth in claim 3 in which said bar has the shape of a rectangular parallelepiped.

5. A wear member as set forth in claim 3 and further comprising means fixing said bar against said continuous supporting surface.

6. A wear member as set forth in claim 5 in which said fixing means comprises a plurality of welds fixing said bar with said inner surface thereof against said supporting surface.

7. A wear member as set forth in claim 5 in which said attaching means comprises a metal structure having openings therein and mechanical means fixing said metal structure to said metal support, said metal structure being embedded in said polymeric material which serves as a matrix therefor with said polymeric material disposed through said openings, said metal structure completely surrounding said peripheral side surface means of said load-carrying means.

8. A wear member as set forth in claim 7 in which said polymeric material is polyethylene having a molecular weight of at least two million.

9. In a coupler carrier wear member for a railway vehicle wherein said vehicle comprises a coupler assembly and a coupler carrier which are relatively movable and said coupler carrier wear member is supported by said coupler carrier and protects said coupler assembly and coupler carrier from wear during relative movement thereof; said wear member comprising; a metal support having a continuous supporting surface; an ultra high molecular weight polymeric material supported by said metal support and having an antifriction wear surface engageable by said coupler assembly; and means attaching said polymeric material to said support; the improvement comprising comparatively rigid load-carrying means embedded within said polymeric material, said load-carrying means having inner surface means thereof engaging said continuous supporting surface and outer surface means thereof disposed substantially coplanar with said wear surface, said load-carrying means having peripheral side surface means extending between said inner and outer surface means thereof and being engaged by said polymeric material completely around said entire peripheral side surface means so that said load-carrying means is completely surrounded at said peripheral side surface means thereof by said polymeric material, said load-carrying means serving to maintain said polymeric material free of substantial indentation under conditions of high impact loading applied simultaneously against said load-carrying means and said polymeric material.

10. A wear member as set forth in claim 9 in which load-carrying means comprises a load-carrying bar of solid cross-sectional configuration made of a metallic material, said bar having said inner and outer surface means thereof defined as opposed substantially planar surfaces which are disposed in spaced parallel relation.

11. A wear member as set forth in claim 10 in which said metal support and bar are made of a ferrous metal and further comprising means fixing said bar against said metal support.

12. A wear member as set forth in claim 11 in which said bar is of solid cross-sectional configuration and said fixing means comprises a plurality of spot welds fixing said bar with said inner surface thereof against said continuous supporting surface.

13. A wear member as set forth in claim 12 in which said attaching means comprises an expanded metal structure having openings therein and mechanical means fixing said expanded metal structure to said metal support, said expanded metal structure being embedded in said polymeric material which serves as a matrix therefor with said polymeric material disposed through said openings, said metal structure completely surrounding said peripheral side surface means of said load-carrying means.

14. A wear member as set forth in claim 13 in which said polymeric material is polyethylene having a molecular weight of at least two million.

15. In a method of making a coupler carrier wear member for a railway vehicle comprising the steps of; providing a metal support; said support having a substantially planar main portion provided with a continuous supporting surface and a pair of depending legs extending in the same direction from opposite side edges thereof; said legs being adapted to be supported against cooperating parts of said coupler carrier; and attaching a polymeric material to said support with said polymeric material having an antifriction wear surface engageable by a coupler assembly of said railway vehicle; the improvement comprising the step of embedding comparatively rigid load-carrying means in said polymeric material with inner surface means thereof engaging said continuous supporting surface and outer surface means thereof disposed substantially coplanar with said wear surface, said step of embedding said load-carrying means causing peripheral side surface means of said load-carrying means that extend between said inner and outer surface means thereof to be engaged by said polymeric material completely around said entire peripheral side surface means so that said load-carrying means is completely surrounded at said peripheral side surface means thereof by said polymeric material, said load-carrying means serving to maintain said polymeric material free of substantial indentation under conditions of high impact loads applied simultaneously against said load-carrying means and said polymeric material.

16. A method as set forth in claim 15 in which said attaching and embedding steps comprise fixing said load-carrying means and a metal structure having openings therein against said continuous supporting surface of said metal support and molding said polymeric material around said load-carrying means and metal structure with inner surface means thereof engaging said continuous supporting surface and outer surface means defining said wear surface as a planar wear surface, said attaching and embedding steps causing said metal structure to completely surround said peripheral side surface means of said load-carrying means.

17. A method as set forth in claim 16 in which said step of fixing said load-carrying means comprises welding said load-carrying means in the form of a load-carrying bar against said continuous supporting surface.

18. A method as set forth in claim 17 in which said step of welding said load-carrying bar comprises welding said load-carrying bar made of metal and having a solid cross-sectional configuration.

19. A method as set forth in claim 18 in which said step of molding said polymeric material comprises molding polymeric material in the form of polyethylene.

20. A method as set forth in claim 19 in which said step of molding said polyethylene comprises molding said polyethylene having a molecular weight of at least two million.

* * * * *